US008888515B2

(12) United States Patent
Hachadorian

(10) Patent No.: US 8,888,515 B2
(45) Date of Patent: Nov. 18, 2014

(54) SOCKET

(75) Inventor: Gary Hachadorian, Frankfurt (DE)

(73) Assignee: Erich Jaeger GmbH + Co. KG, Freiberg (DE)

( * ) Notice: Subject to any disclaimer, the term of this patent is extended or adjusted under 35 U.S.C. 154(b) by 33 days.

(21) Appl. No.: 13/814,363

(22) PCT Filed: Aug. 11, 2010

(86) PCT No.: PCT/EP2010/004911

§ 371 (c)(1),
(2), (4) Date: Feb. 5, 2013

(87) PCT Pub. No.: WO2012/019625

PCT Pub. Date: Feb. 16, 2012

(65) Prior Publication Data

US 2013/0130525 A1 May 23, 2013

(51) Int. Cl.

| | |
|---|---|
| ***H01R 13/447*** | (2006.01) |
| ***H01R 13/52*** | (2006.01) |
| *H01R 13/639* | (2006.01) |

(52) U.S. Cl.

CPC ..... *H01R 13/447* (2013.01); *H01R 13/5213* (2013.01); *H01R 2201/26* (2013.01); *H01R 13/6395* (2013.01)

USPC ..... 439/142

(58) Field of Classification Search

USPC ..... 439/142, 135, 686; 220/826, 324

See application file for complete search history.

(56) References Cited

U.S. PATENT DOCUMENTS

| | | | | | |
|---|---|---|---|---|---|
| 1,804,908 | A * | 5/1931 | Wichert | 439/142 |
| 4,098,427 | A * | 7/1978 | Duckworth, Jr. | 220/259.2 |
| 4,342,493 | A * | 8/1982 | Grenell | 439/142 |
| 5,501,607 | A * | 3/1996 | Yoshioka et al. | 439/142 |
| 5,660,295 | A * | 8/1997 | Hroma et al. | 220/324 |
| 7,458,482 | B2 * | 12/2008 | Yasuda et al. | 220/826 |
| 2004/0074745 | A1 * | 4/2004 | Castaldo | 200/50.28 |

FOREIGN PATENT DOCUMENTS

| | | |
|---|---|---|
| DE | 29 07 051 | 9/1980 |
| DE | 44 16 992 | 11/1994 |
| DE | 44 13 141 | 10/1995 |
| DE | 298 06 587 | 8/1999 |
| DE | 20 2009 002 880 | 8/2010 |

* cited by examiner

*Primary Examiner* — Alexander Gilman
(74) *Attorney, Agent, or Firm* — Michael J. Striker

(57) ABSTRACT

The present invention relates to a socket for connecting a plug in the external region of a motor vehicle, comprising a socket housing, in which a plug-receiving opening having electric contacts for plugging in a plug and establishing an electric connection is formed, and comprising a cover, which is hinge-mounted on the socket housing and closes the plug-receiving opening in the closed position of the cover and which is preloaded in the closing direction, wherein a hold-closed mechanism that increases the holding force of the cover in the closed position thereof is provided.

9 Claims, 6 Drawing Sheets

SOCKET

CROSS-REFERENCE TO A RELATED APPLICATION

The invention described and claimed hereinbelow is also described in International Application No. PCT/EP 2010/04911, filed on Aug. 11, 2010, whose subject matter is incorporated herein by reference, and provides the basis for a claim of priority of invention under 35 U.S.C. 119(a)-(d).

BACKGROUND OF THE INVENTION

The invention relates to a socket for connecting a plug in the external region of a motor vehicle, comprising a socket housing, in which a plug-receiving opening having electric contacts for plugging in a plug and establishing an electric connection is formed, and comprising a cover, which is hinge-mounted on the socket housing and closes the plug-receiving opening in the closed position of the cover and which is preloaded in the closing direction. In the closed position, a seal accommodated in the cover interacts with the edge of the plug-receiving opening, as a sealing surface, thereby preventing water from entering the plug-receiving opening when the socket is not connected to a plug and the plug-receiving opening is covered by the cover.

Covers that are hinge-mounted on the socket housing are usually supported on a hinge and are loaded in the closing direction with the aid of a leg spring. For this reason, the moment acting in the closing direction on the cover is greater in the open position than in the closed position of the cover. In a completely or partially open position of the cover, the spring force of the leg spring must be just high enough to allow the cover to close when released. In order to improve the seal integrity of the socket between the closed cover and the wall of the plug-receiving opening, it is absolutely desirable for the spring force to also be as high as possible in the closed position of the cover. This could be achieved by way of a sufficiently strong leg spring that, however, would develop a closing force in the open position of the cover that is so great that a considerable risk of injury exists when the cover in the open position is accidentally released and a finger is clamped between the cover and the socket housing. In order to minimize the risk of injury, the closing force of the cover is limited in sockets currently on the market.

In practical application, especially when the sockets are used in the field of agriculture or in trucks, this results in problems of seal integrity since trucks and agricultural devices often become very dirty during use and may be cleaned using high-pressure cleaners. The force of the water jet can potentially lift the cover out of the closed position thereof, thereby allowing moisture to enter the contact region of the socket, which can cause short circuits in subsequent use. Water entering the interior of the socket can also result in unwanted corrosion of the electric contacts.

The problem therefore arose of providing a socket that results in an improved hold of the cover in the closed position of the cover. According to an important application, the seal of the contact region is improved by way of an increased closing force of the cover bearing against the wall of the plug-receiving opening.

SUMMARY OF THE INVENTION

The aforementioned problem is solved according to the invention via the features of claim 1 in that, in particular, a hold-closed mechanism that increases the holding force of the cover in the closed position thereof is provided on the socket. According to the invention, this hold-closed mechanism does not form a rigid lock that must be unlocked using a locking bar before opening, but rather an arrangement is formed that comprises a holding element that acts on the cover or a locking clamp only in the closed position and is movable against a force that is adjustable, in particular. This holding element acts on the cover or the locking clamp in the closed position of the cover or the locking clamp and holds the cover or the locking clamp supporting the cover closed by way of an additional force that acts in the closing direction, in particular, and that must be overcome when opening the cover. According to the invention, however, this additional holding force does not preload the cover further in the closing direction. According to the invention, there is no need to unlock the cover or the locking clamp separately, for example by manually releasing or actuating an unlocking element. According to the invention, however, no additional force acts in the closing direction of the cover in an open position of the cover that differs from the closed position. The closed position of the cover need not necessarily be the position of the cover in which the cover bears with maximum force against a wall of the plug-receiving opening or a seal for sealing the contact region. The closed position of the cover can also be a position in which the cover—independently of the preload force acting in the closing direction—bears with a defined contact pressure against the seal or the wall of the plug-receiving opening. This position can be defined, for example, by a defined distance of the cover from the wall of the plug-receiving opening and can be used to set the contact pressure on the seal in a defined manner such that a reliable seal is attained and the force acting on the seal is not so great that the seal is damaged over time by the force acting upon the seal.

In general, the invention therefore relates to increasing the holding force of the cover in a previously defined closed position. The closed position need not necessarily be a position in which the cover bears with maximum closing force against a wall of the plug-receiving opening. Instead, the closed position is a position of the cover in which the cover should be located when in the closed position even when the opening to be closed is not closed completely or is not closed with maximum force in this position. In a preferred application, the additional holding force is a closing force of the cover for sealing a plug-receiving opening.

To build up the holding force according to the invention, the hold-closed mechanism preferably comprises a holding element that deflects against a return force and applies an additional holding force to the cover in the closing direction in the closed position of the cover. After this holding force is overcome, the holding element deflects in a guide provided for this purpose. A holding force acting in the closing direction of the cover is no longer applied onto the cover after the cover or a separate locking clamp, which can be part of the hold-closed mechanism and acts on the cover, moves out of the closed position. This is achieved even after the cover or locking clamp has been opened from the closed position about a small angle of opening of 5 to 10°, for example. In this context, it is particularly advantageous for the guide to be designed such that the holding element is moved in the guide substantially perpendicularly to the additionally acting holding force.

According to a particularly preferred and robust embodiment, the holding element can engage into a receiving opening for this purpose in the closed position of the cover and/or the locking clamp. The holding element accommodated in the receiving opening is designed such that it bears against the edge or the inner wall of the receiving opening in order to exert the additional holding force on the cover and increase the closing force of the cover in the closed position of the cover. However, if a force that overcomes the additional holding force is exerted upon the holding element in the opening direction, the holding element deflects in the guide against the return force of the holding element. This is pressed out of the receiving opening and is guided in the guide provided therefor. If the holding element is accommodated completely in the guide or the guide opening, the holding element preferably bears against a wall or guide surface that absorbs the return force of the holding element and against which the holding element is pressed by way of the return force of the holding element.

When the holding element moves relative to this surface, only a slight frictional force acts in the closed position as compared to the additional holding force. Provided the cover or the locking clamp of the cover is in an open position that differs from the closed position, the cover or the locking clamp can therefore be moved relative to the socket housing without applying an appreciable additional force. In particular, this frictional force does not cause force to be applied in the closing direction of the cover or the locking clamp.

The additional holding force in the closed position of the cover or the locking clamp can be achieved, advantageously, when the holding element has a rounded and/or beveled surface for transferring force onto a surface that absorbs the additional holding force. By way of a suitable bevel or rounding having a suitable radius of curvature, the holding force is preferably applied at a point or a surface area of the receiving opening, for example, thereby allowing the force and the direction thereof to be easily controlled. In particular, the bevel or rounding can be designed such that, in the closed position, the force applied via the opening motion largely acts in the direction of the surface that absorbs the additional holding force and merely to a small extent obliquely or, in particular, perpendicularly to the holding direction. By way of this force acting obliquely or perpendicularly to the holding force, the holding element is then moved against the return force thereof out of the receiving opening and releases the cover or the locking clamp for an opening motion. The force ratios can be set in an optimal manner via the angle between the tangential direction of the rounding or the bevel and the engagement point on the surface that absorbs the holding force, which is also referred to as a holding surface. By way of this dynamic angle of engagement according to the invention, the additional holding force can be easily set and designed such that this acts selectively only in the desired position of the cover or the locking clamp.

It has been shown that the holding element is a ball in a particularly preferred embodiment according to the invention. This ball can be movably accommodated in the guide or the guide opening, which has an inner diameter corresponding to the diameter of the ball, in particular. Therefore, the ball can move freely in the guide opening. According to a simple embodiment, the guide opening can be designed in the manner of a blind hole, i.e. the guide opening can comprise an open end and a closed end. A spring, in particular a coiled spring, can be accommodated in the guide opening as the element generating the return force of the holding element, the spring bearing against the closed end of the guide opening and, at the opposite end, impacting the ball, which is also accommodated in the guide opening. The length of the guide opening or the spring is sized such that the spring and the ball impacting the spring are not accommodated completely in the guide opening in the non-loaded state of the spring. By loading the spring, the ball can then be pressed completely into the guide opening, and so the spring preloads the ball in the direction of the open end of the guide opening by way of the return force of the spring. In the assembled state of the socket or the hold-closed mechanism according to the invention, the ball bears against a wall or guide surface that closes the open end of the guide opening and in which the receiving opening for partially accommodating the ball or the holding element in general is formed. In the closed position of the cover or the locking clamp, the holding element partially enters the receiving opening and generates the additional holding force according to the invention by bearing against the (inner) wall of the receiving opening.

The holding element need not be a ball, as previously indicated, but rather can absolutely be designed as a holding element having any other shape. However, the ball is particularly advantageous because the holding element cannot tilt in the guide opening, simple assembly without a preferred direction of the holding element is possible, and only slight frictional force is generated when the holding element is moved out of the receiving opening in the closed position and bears against the wall or guide surface. In addition, the ball makes it possible for the holding force to be applied in only one point onto the wall or edge of the receiving opening and, in fact, in the tangential direction and a direction that is normal to the tangential direction.

According to a particularly advantageous embodiment, the inner diameter of the receiving opening is smaller than the outer diameter of the ball. Preferably, however, the receiving opening is only slightly smaller than the outer diameter of the ball, i.e. preferably approximately 5 to 15% smaller. As a result, the tangent on the ball surface in the closed position of the cover or the locking clamp is oriented virtually parallel to the wall of the receiving opening, and so a large force component acts in the direction of the holding force against the wall of the receiving opening, and only a small force component is applied perpendicularly thereto in the direction against the return force of the spring. Therefore, a particularly great additional force is generated and a minimal force component opposed to the return force is attained, thereby ensuring that the force required to overcome the holding force when opening the cover or the locking clamp is very great.

In another embodiment of the invention, the holding element can also be integral with a flexible element and have a preferably rounded or beveled region for engaging into a receiving opening. The flexible element can be made of plastic or can be embodied as a spring blade. In this embodiment, the holding elements and the spring for generating the return force are therefore preferably made of a material, wherein sufficient return space is formed in the socket, in the hold-closed mechanism or the cover or the locking clamp itself for moving the flexible element—comprising the holding element integrally formed therewith or attached thereto—out of the position thereof, which is located in a receiving opening, into a position in which the opening motion of the cover or locking clamp is released.

According to a particularly preferred embodiment, the holding element, including the element thereof that generates the return force, is supported in the socket housing. Sufficient installation space is usually available there for accommodating the holding element and, for example, a spring for generating the return force in the guide opening of the guide. However, the invention is not expressly limited to such an embodiment, but rather also comprises embodiments in which the holding element is accommodated in the cover itself or the locking clamp, for example.

In a holding element supported in the socket housing, the receiving opening can be formed, according to the invention, in the cover itself. As a result, force of the holding element acts directly on the cover and, therefore, reliable closing action is attained.

In an alternative embodiment, the receiving opening can also be formed in a locking clamp that is preferably hinge-mounted in a swivellable manner on the socket housing and can be folded over the cover in the closed position thereof. In this position, the holding element engages into the receiving opening of the locking clamp, which then secures the cover.

As previously mentioned, in another embodiment, the holding element in the cover or the locking clamp can be movably guided against a return force, and a receiving opening can be formed in the socket housing, for example. The remaining features of the hold-closed mechanism and/or the socket can also be implemented accordingly in this embodiment.

Simple handling of the locking clamp and reliable closing action can be attained when the locking clamp is hinge-mounted on a side of the socket housing opposite that of the cover relative to the plug-receiving opening.

In this embodiment, the cover and the locking clamp therefore fold toward one another, wherein the cover is preloaded in the closing direction and the locking clamp must then be actuated manually, according to a preferred embodiment of the invention. In order to open the cover from the closed position, the locking clamp can first be opened manually against the additional holding force of the hold-closed mechanism. However, it is also possible to release the locking clamp by lifting the cover using appropriate force.

According to the invention, the locking clamp comprises at least one, but preferably two arms that can be swiveled over the edge of the cover and that bear against a pressing surface of the cover in the closed position of the cover and the locking clamp in order to apply the additional holding force onto the cover. The contact or pressing surface between the arm or the arms of the locking clamp and the socket can be formed in the center relative to the plug-receiving opening in the direction transversely to the swiveling axis of the cover and the locking clamp. As a result, uniform contact pressure is attained, which may optionally also be adjustable via elongated holes in the cover support and the cover spring for preloading the cover in the closing direction.

BRIEF DESCRIPTION OF THE DRAWINGS

Further features, advantages, and possible applications of the present invention will also become apparent from the following description of exemplary embodiments and the drawings. All the features that are described and/or graphically depicted are the subject of the present invention, either alone or in any combination Shown are:

FIG. 4 the socket according to FIG. 1 with the plug plugged in;

DETAILED DESCRIPTION OF THE INVENTION

Figure 1:
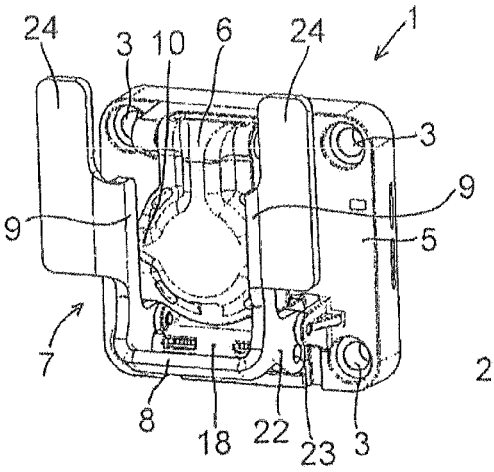
FIG. 1 a socket according to the invention in a three-dimensional view, comprising a hold-closed mechanism according to the invention, which has a locking clamp, in the closed position of the cover and the locking clamp.
Figure 4:
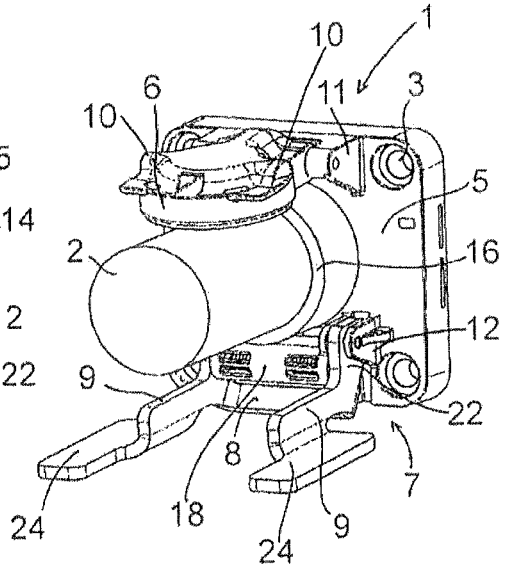

The socket 1 shown in FIG. 1 is used to connect a plug 2, which is shown in FIG. 4. The socket 1 is typically installed in the external region of a motor vehicle and is used to connect trailers or other types of electric consumers to the electric circuit of the motor vehicle. To this end, the socket 1 can be screwed onto the motor vehicle using non-illustrated screws via the attachment openings 3.

The present invention is suitable, in particular, for use in towing vehicles that are used in the field of agriculture or construction machinery, and can be connected to the trailers or any other type of machines having a separate electric circuit. The trailers or machines are equipped with a plug 2, which can be plugged into the socket 1, in order to supply electricity to the trailers or machines.

Figure 3:
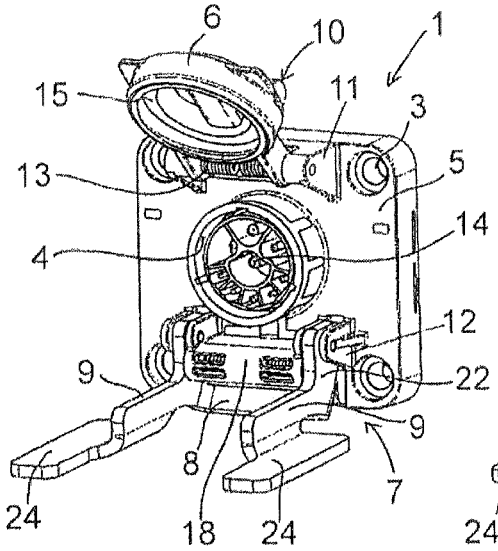
FIG. 3 the socket according to FIG. 1 with the cover open and the locking clamp open.

The socket 1 is shown in a state in FIG. 1 in which a plug 2 is not plugged into the socket 1. A plug-receiving opening 4, which is shown in FIG. 3 and is provided for insertion of the plug 2, is closed in a sealed manner by a cover 6 hinge-mounted on the socket housing 5, as shown in FIG. 1. The cover 6 is preloaded in the closing direction and is additionally secured by way of a hold-closed mechanism 7, which increases the holding and closing force of the cover 6 in the closed position thereof. To this end, the hold-closed mechanism 7 comprises a locking clamp 8 having two arms 9, each of which extends over an edge of the cover 6 and bears against a pressing surface 10 of the cover 6 in the closed position of the cover 6 and the locking clamp 7, in order to apply the additional holding force provided according to the invention onto the cover 6.

The locking clamp 8 is hinge-mounted on the socket housing 5 similar to the cover 6, wherein the swiveling axes of the cover 6 and the locking clamp 8 are oriented parallel to and separated from one another, and so the swiveling directions of the cover 6 and the locking clamp 8 are located in parallel planes with respect to one another.

Figure 2:
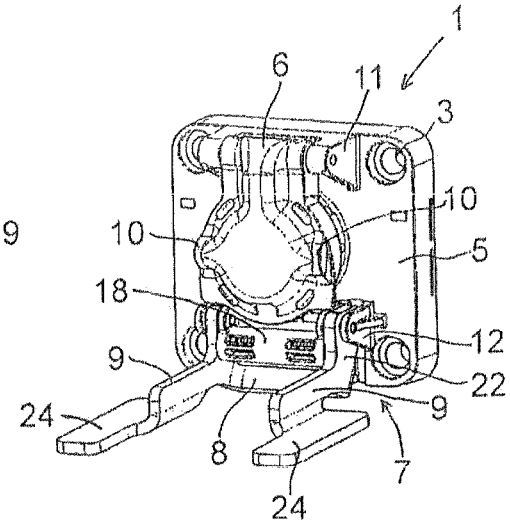
FIG. 2 the socket according to FIG. 1 with the locking clamp open.

As shown clearly in FIG. 2, the cover 6 is hinge-mounted on the socket 1 via a cover holder 11, which is integrally connected to the socket housing 5, and the locking clamp 8 is hinge-mounted on the socket 1 via a clamp holder 12, which is integrally connected to the socket housing 5. The cover holder 11 and the clamp holder 12 are located on opposite sides of the plug-receiving opening 4 and are disposed such that the swiveling axes for the cover 6 and the locking clamp 8 are disposed parallel to one another in the manner described. Therefore, the cover 6 and the locking clamp 8 are folded over the plug-receiving opening 4 from different sides. In FIG. 2, the cover 6, which is preloaded in the closing direction, is located on the plug-receiving opening 4. The locking clamp 8 comprising the two arms 9 is shown in an open position. Since the locking clamp 8 is not preloaded in the direction of the open position thereof nor in the direction of the closed position thereof, the locking clamp 8 remains in the position shown in FIG. 2 after opening.

The arms 9 of the locking clamp 8, which are straight or planar on the side thereof facing the cover 6, come to lie on rounded pressing surfaces 10 of the cover 6 in the closed position of the cover 6 and the locking clamp 8, wherein the pressing surfaces 10 are disposed in the center of the plug-receiving opening 4 in a direction transverse to the swiveling axes of the cover 6 and the locking clamp 8, and so, in the closed position of the locking clamp, the arms 9 apply uniform contact pressure in the center of the cover 6 and achieve a reliable sealing effect.

When the locking clamp 8 is open, as shown in FIG. 2, the cover can be opened against the preload force thereof, which is applied via a cover spring 13, as shown in FIG. 3. The plug-receiving opening 4, which comprises contacts 14 disposed therein for insertion of the plug 2, is thereby exposed. In order to seal the plug-receiving opening 4 in the closed position of the cover 6, an annular seal 15 is disposed in the cover 6 and interacts with the end-face wall of the plug-receiving opening 4 as a sealing surface in the closed position of the cover 6.

Figure 5:
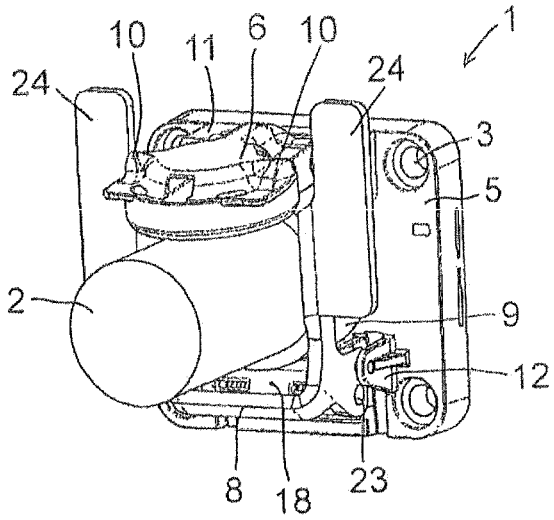
FIG. 5 the socket according to FIG. 1 with the plug secured by the locking clamp.

FIG. 4 schematically depicts a plug 2, which is plugged into the socket 1 and comprises a flange-type projection 16 at a position corresponding to the pressing surfaces 10 of the cover 6. Therefore, the locking clamp 8 can be folded back in the direction of the plug-receiving opening such that the arms 9 lie on the flange-type projection 16 and also apply an additional holding force onto the plug 2 in the state in which said plug is inserted into the socket 1. This is illustrated in FIG. 5.

Figure 6:
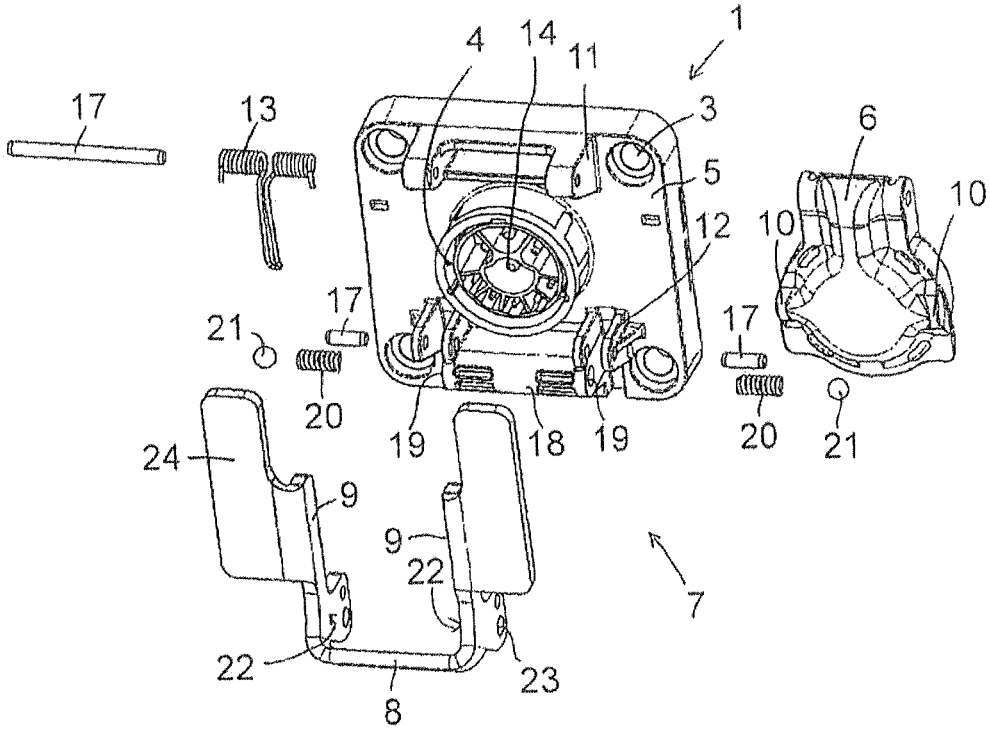
FIG. 6 the socket according to FIG. 1, in an exploded view.

FIG. 6, which follows, shows the socket 1 comprising the cover 6 and the hold-closed mechanism 7 in an exploded drawing that shows the design and mode of operation of the hold-closed mechanism 7 according to the invention in greater detail.

The cover 6 of the socket 1 is fastened on the cover holder 11 by way of a spiral wrapped pin 17, wherein the spiral wrapped pin also accommodates a cover spring 13, which is in the form of a leg spring, in order to preload the cover 6 in the direction of the closed position thereof. The cover 6 therefore lies on the end-face wall of the plug-receiving opening 4 when a plug 2 is not plugged into the socket 1. Therefore, the contacts 14 located in the plug-receiving opening 4 are protected against moisture entering since the annular seal 15 disposed in the cover 6 lies on the end face of the plug-receiving opening 4.

The preload of the cover spring 13 cannot be so great that serious injuries (pinching) occur when the cover 6 is accidentally released from the open position thereof and a finger is pinched between the cover 6 and the end-face wall of the plug-receiving opening 4. However, the closing force that can be achieved under this condition is usually insufficient to reliably hold the cover 6 in the closed position thereof when the towing vehicle is cleaned using a pressurized water jet, for example. Previously, the cover 6 was usually easily lifted in this case, and moisture entered the plug-receiving opening 4. This can lead to short circuits or corrosion of the electric contacts in subsequent use.

In order to apply an additional holding force on the cover 6 in the closed position thereof, the additional hold-closed mechanism 7 is provided according to the invention, wherein, in this embodiment, said hold-closed mechanism comprises a locking clamp 8, which is hinge-mounted on the clamp holder 12 by way of two spiral wrapped pins 17. The hold-closed mechanism 7 further comprises a guide 18 having two guide openings 19 disposed axially on opposite sides of the guide 18, the axes of which preferably extend parallel to the swiveling axis of the locking clamp 8 defined by the spiral wrapped pins 17 in the clamp holder 12.

A compression spring 20 and a ball 21 are accommodated in the guide opening 19, which is embodied as a type of blind hole, in such a manner that the ball 21, which functions as a holding element, can be pressed against a return force of the compression spring 20 into the guide opening 19. In the installed state of the locking clamp 8, the balls 21 are held against the return force of the compression springs 20 in the guide opening 19 since, in the closed position of the locking clamp 8, the balls 21 bear against a wall or guide surface 22 of the locking clamp 8. In the closed position of the locking clamp 8, receiving openings 23 are provided in the wall surface 22 in front of each of the guide openings 19 and permit the balls 21 to partially emerge from the guide openings 19 into the receiving openings 23.

To this end, the guide openings 19 and the receiving openings 23 are coaxially disposed in the closed position of the locking clamp 8 and, therefore, of the cover 6, wherein the diameter of the receiving openings 23 is smaller than the diameter of the guide openings 19, thereby preventing the balls 21 from emerging completely from the guide opening 19. The balls also interact with the inner wall or edge of the receiving openings 23 and so, in the closed position of the locking clamp 8, an additional holding force is applied onto the locking clamp 8 or cover 6 in that the arms 9 lie on the pressing surfaces 10 of the cover 6 and press the annular seal disposed in the cover 6 onto the end-face wall of the plug-receiving opening.

Figure 7:
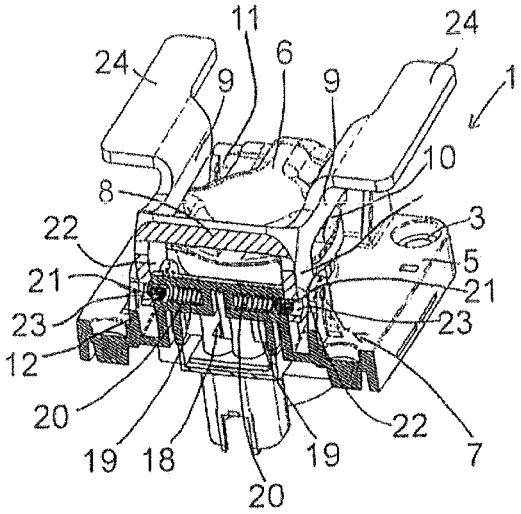
FIG. 7 a sectional detail view of the socket according to FIG. 1 in the region of the hold-closed mechanism with the cover closed and the locking clamp closed.
Figure 8:
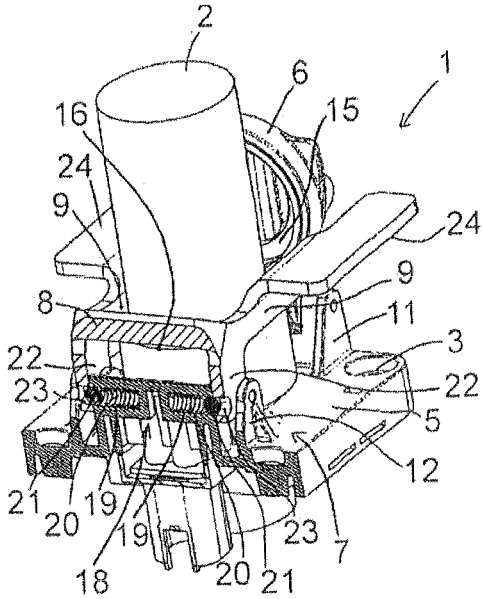
FIG. 8 a sectional detail view according to FIG. 1 in the region of the hold-closed mechanism with the plug plugged in and the locking clamp closed.
Figure 9:
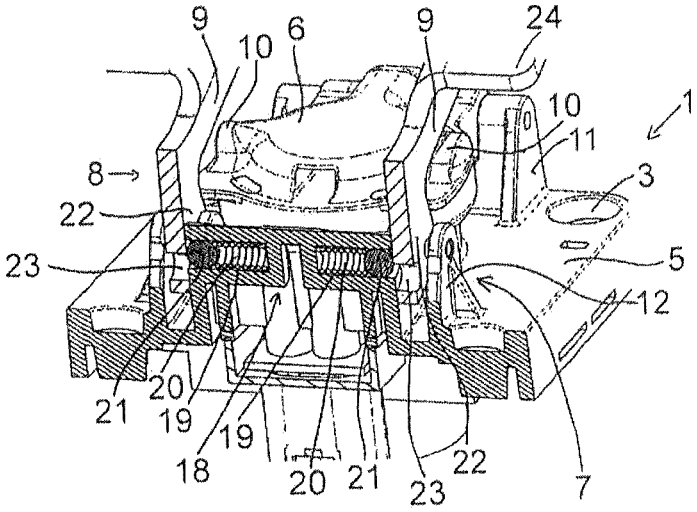
FIG. 9 a sectional detail view of the socket according to FIG. 1 with the locking clamp partially open.

This is illustrated once more in FIGS. 7 to 9. FIG. 7 shows the locking clamp 8 in the closed position thereof, in which the arms 9 thereof lie on the pressing surface 10 of the cover 6. The compression springs 20 and the balls 21, which function as holding elements, are accommodated in the guide 18 of the socket housing 5 having the two guide openings 19, wherein each compression spring 20 is compressed and a return force is generated when the ball 21 is accommodated entirely in the guide opening 19.

This return force of the compression springs 20 causes the balls—in the closed position of the locking clamp 8—to partially enter the receiving openings 23 in the wall or guide surface 22 positioned in front of the guide opening 19, and therefore an additional force must be generated in order to open the locking clamp 8, wherein this additional force presses the balls 21 completely back into the guide opening 19. As a result, an additional holding force is applied onto the cover 6 without this cover being locked using a rigid locking mechanism that would break off if excessive force were applied and would result in damage to the socket 1 or the additional hold-closed mechanism 7.

If the force applied onto the locking clamp 8 becomes too great, the additional holding force on the locking clamp 8 is overcome and the locking clamp 8 opens in the same manner as when the locking clamp 8 is opened properly by pulling on the pulling surfaces 24 of the locking clamp 8, said pulling surfaces being formed on the arms 9 of the locking clamp 8 in a laterally outwardly projecting manner, in particular.

A corresponding situation in respect of the hold-closed mechanism 7 results when the plug 2 is plugged into the socket and the locking clamp 8 is located in the closed position thereof. This is illustrated in FIG. 8.

FIG. 9 shows the locking clamp 8 in a partially open position, in which the arms 9 of the locking clamp 8 are lifted partially off of the pressing surfaces 10 of the cover 6. In this position of the locking clamp 8, the balls 21 are pressed against the return force of the compression springs 20 via the wall surface 22 of the locking clamp 8 into the guide opening 19, thereby permitting the locking clamp 8 to move freely except for a slight frictional force of the balls 21 on the wall surface 22. An appreciable additional holding force is exerted upon the locking clamp 8 and, in particular, a return force does not act on the locking clamp 8 in the direction of the closed position thereof.

Figure 10:
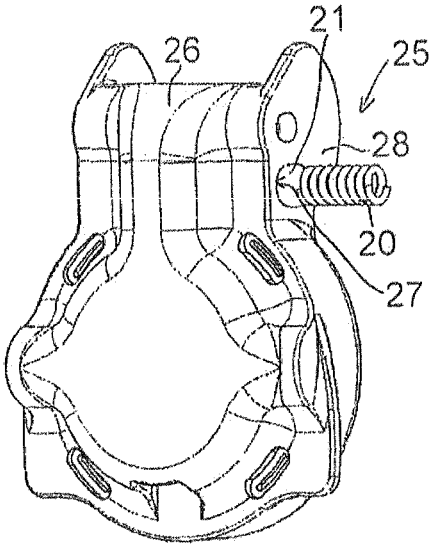
FIG. 10 a second embodiment of the socket according to the invention, comprising a hold-closed mechanism acting directly on the cover, in the closed position of the cover.
Figure 11:
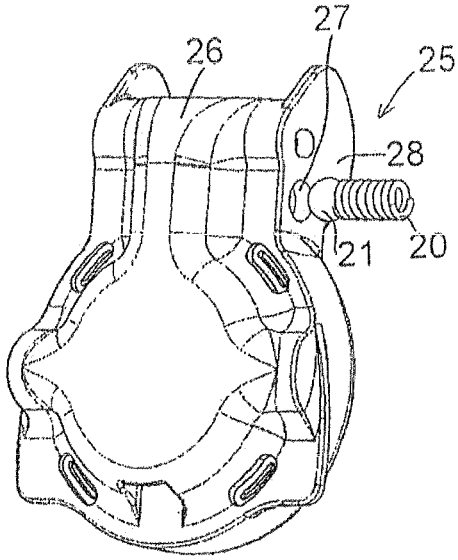
FIG. 11 the socket according to FIG. 10 in the open position of the cover.

FIGS. 10 and 11 and 12 and 13 show a further embodiment of the hold-closed mechanism 25, which acts directly on a cover 26, 30 of a non-illustrated socket. The socket is designed similarly to the previously described socket 1, with the exception that the guide 18 is formed directly adjacent to the cover holder 11, in which the cover 26 is supported. This guide, which is also not shown, is designed such that the guide opening guides the ball 21 and compression spring 20, which are shown in FIGS. 10 and 11, on both sides of the cover. The receiving opening 27, which the ball 21 enters in the closed position of the cover 26, is formed in a wall surface 28 of the cover 26 against which the ball 21 bears when it is pressed completely into the guide opening. FIG. 10 shows the cover 26 in the closed position, while FIG. 11 shows a partially open cover 26.

Figure 12:
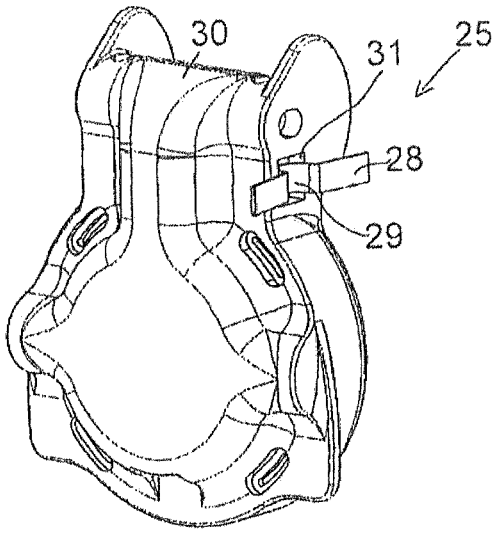
FIG. 12 a third embodiment of a socket according to the invention, comprising a hold-closed mechanism acting directly on the cover, in the closed position of the cover.
Figure 13:
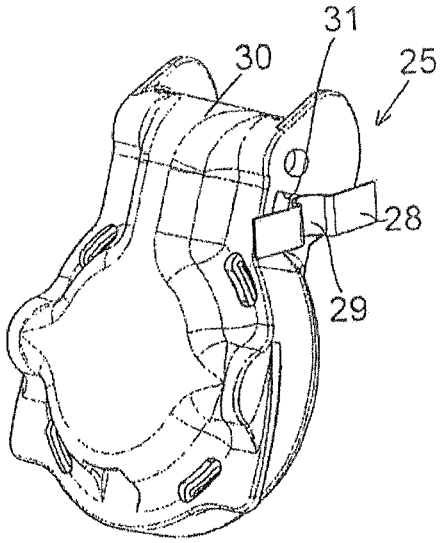
FIG. 13 the socket according to FIG. 12 in the open position of the cover.

A further embodiment of the present invention is shown in FIGS. 12 and 13. Therein, the ball 21, which functions as a holding element, and the compression spring 20 are replaced by a flexible element 28 that is fastened on the socket housing and comprises a holding element 29, which is curved in a semicircular shape and which, in the closed position of the cover 30, engages into a receiving opening 31 formed in the cover 30 in accordance with the shape of the holding element 29 when the cover 30 is in the closed position thereof. When the cover 30 is opened, the holding element 29 of the flexible element 28 is pressed out of the receiving opening 31, for the purpose of which a corresponding receiving space is provided in the socket.

Therefore, the additional locking clamp 8 of the first embodiment was omitted in the above-described embodiments according to FIGS. 10 and 11 and FIGS. 12 and 13, and so the hold-closed mechanism 25 acts directly on the cover 26, 30 in each case.

It is understood that other embodiments of the holding element, which deflects against a return force, are possible given the same operating method.

The preferred kinematics of the hold-closed mechanism 7, 25 are described in the following with reference to the schematic illustrations of FIGS. 14 to 17, wherein reference is made to a ball 21 as the holding element. However, the same functionality can be achieved using holding elements 29 having other shapes, for example rounded or beveled shapes.

Figure 14:
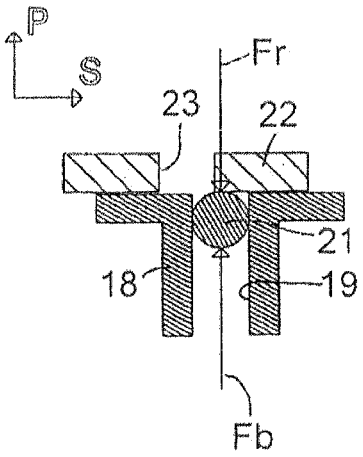
FIG. 14 a schematic diagram of the hold-closed mechanism in the open position.

FIG. 14 shows a guide 18 for the ball 21, which is acted upon by a return force Fb via the compression spring 20 and which functions as the holding element according to the invention. The reaction force to the return force Fb is indicated by Fr, which is absorbed by the wall surface 22 according to the position shown in FIG. 14, wherein said wall surface is neither part of the locking clamp 8 nor the cover 26. This corresponds to an open position of the cover 26 or the locking clamp 8. In the coordinate system shown, the axis P extends parallel to the rotational axis of the cover 26 or the locking clamp 8, and the axis S is perpendicular thereto.

As shown in FIG. 14, the ball 21 is accommodated completely in the guide opening 19. The reaction force Fr is then opposed to the return force Fb, wherein the forces Fr and Fb are each oriented parallel to the axis P.

Figure 15:
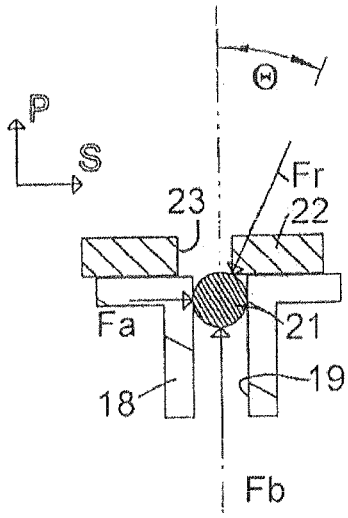
FIG. 15 a schematic diagram of the hold-closed mechanism during the closing procedure, in a first position.
Figure 16:
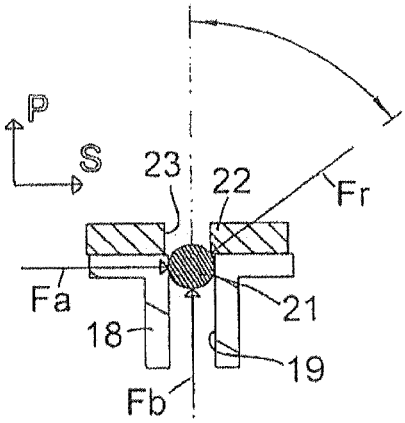
FIG. 16 a schematic diagram of the hold-closed mechanism during the closing procedure, in a second position.
Figure 17:
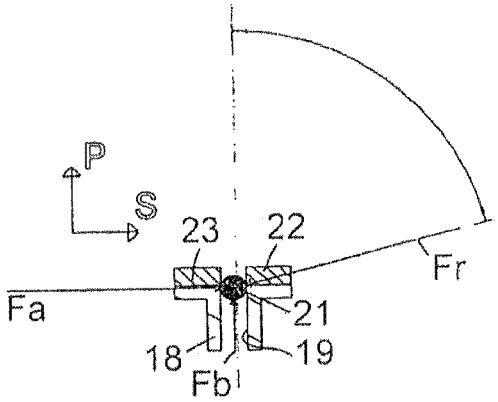
FIG. 17 a schematic diagram of the hold-closed mechanism in the closed position.

As shown in FIG. 15, as soon as the ball 21 begins to enter the receiving opening 23, the reaction force Fr is oriented in the direction normal to the tangent of the ball 21 in the contact point of the ball 21 with the wall or guide surface 22 (edge of the receiving opening 23). As a result, an angle of engagement θ forms between the return force Fr and the axis P, and therefore the reaction force Fr comprises a force component Fa in the direction of the axis S, which extends perpendicularly to the rotational axis P and exerts an additional holding force when the cover is opened. This additional component Fa is still relatively small in the position of the ball 21 shown in FIG. 15 since the ball is only minimally accommodated in the receiving opening 23. The force component Fa increases when the receiving opening 23 is oriented substantially parallel to the guide opening 19, as illustrated in FIG. 16.

When the receiving opening 23 and the guide opening 19 are oriented entirely parallel, which corresponds to a closed position of the cover 26 or the locking clamp 8, the ball 21 enters the receiving opening 23 as far as possible, wherein said receiving opening has an inner diameter that is smaller than the outer diameter of the ball 21. In this case, the force component Fa increases considerably in the direction of the axis S, although the return force Fb of the spring diminishes due to the ball 21 deflecting. A particularly great additional holding force on the cover is generated.

A very high reaction force Fr must be applied onto the cover in order to generate a force component in the direction of the axis P that overcomes the return force Fb. As a result, the very high additional holding force in the closed position of the cover or the locking clamp is attained without an additional return force being exerted upon the cover in the open position of the cover or the locking clamp.

Therefore, the additional holding force according to the invention occurs selectively only in the state of a closed cover or locking clamp, thereby minimizing the risk of injury due to an unintentional closing of the cap or the locking clamp while simultaneously ensuring a particularly high closing force of the cover that prevents moisture from entering the plug-receiving opening 4.

Figure 18:
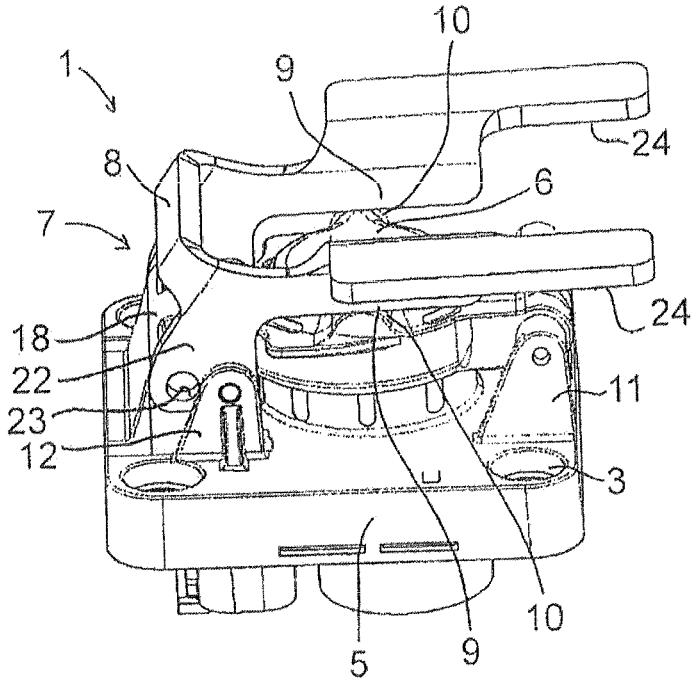
FIG. 18 the socket according to FIG. 1, in a three-dimensional side view and FIG. 19 the socket in the view according to FIG. 18 in a sectional view.
Figure 19:
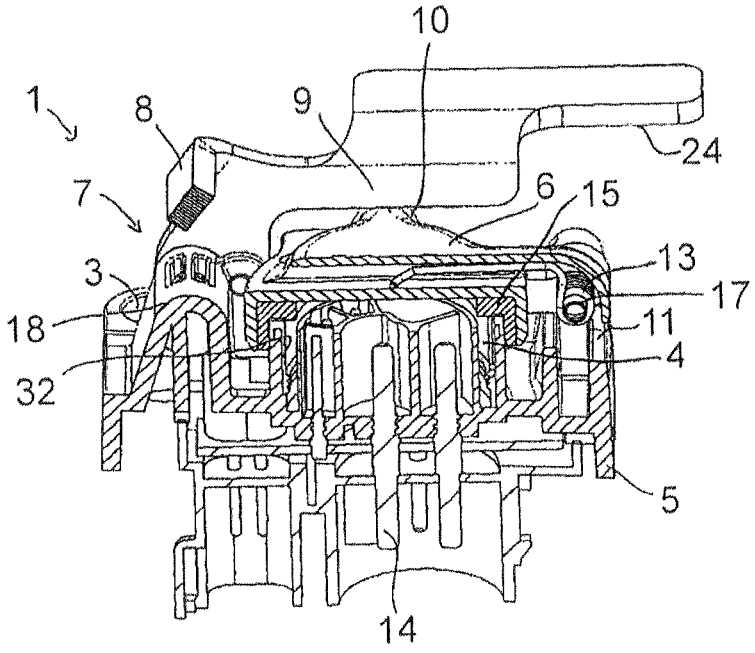

FIG. 18 shows the interaction of the arm 9 of the locking clamp 8 of the first embodiment with the round pressing surface 10 of the cover 4, by way of which, as shown in the sectional drawing according to FIG. 19, a particularly uniform pressing force is exerted upon the annular seal 15 of the cover that lies on the end-face wall of the plug-receiving opening 4. An additional seal 32 can be installed on this end-face wall.

LIST OF REFERENCE CHARACTERS

1 socket
2 plug

3 attachment opening
4 plug-receiving opening
5 socket housing
6 cover
7 hold-closed mechanism
8 locking clamp
9 arm
10 pressing surface
11 cover holder
12 clamp holder
13 cover spring
14 contacts
15 annular seal
16 flange-type projection
17 spiral wrapped pin
18 guide
19 guide opening
20 compression spring
21 ball, holding element
22 wall or guide surface
23 receiving opening
24 pull surface
25 hold-closed mechanism
26 cover
27 receiving opening
28 flexible element
29 holding element
30 cover
31 receiving opening
32 seal

What is claimed is:

1. A socket for connecting a plug (2) in an external region of a motor vehicle, comprising a socket housing (5) formed with a plug-receiving opening (4) having electric contacts (14) adapted for plugging in a plug (2) and establishing an electric connection, a cover (6, 26, 30) hinge-mounted on the socket housing (5) is preloaded in the closing direction and closes the plug-receiving opening (4) in the closed position of the cover, and a hold-closed mechanism (7, 25) that increases a holding force of the cover (6, 26, 30) in the closed position thereof, the hold-closed mechanism comprising a holding element (21, 29) embodying a ball (21) that engages in the closed position into a receiving opening (23), deflects against a return force and applies an additional holding force to the cover (6, 26, 30) in the closing direction, in the closed position of the cover, wherein an inner diameter of the receiving opening (23) is smaller than the outer diameter of the ball (21).

2. The socket according to claim 1, wherein the holding element (21, 29) has a rounded surface, a beveled surface or both for transferring force onto a surface that absorbs the additional holding force.

3. The socket according to claim 1, wherein the holding element (29) is integral with a flexible element (28) and is configured with a rounded or beveled region for engaging into the receiving opening (31).

4. The socket according to claim 1, wherein the holding element (21, 29) is supported in the socket housing (5).

5. The socket according to claim 1, wherein the receiving opening (31) is formed in the cover (26, 30).

6. The socket according to claim 1, wherein the receiving opening (23) is formed in a locking clamp (8, 30).

7. The socket according to claim 6, wherein the locking clamp (8) is hinge-mounted on a side of the socket housing (5) opposite that of the cover (6) relative to the plug-receiving opening (4).

8. The socket according to claim 7, wherein the locking clamp (8) comprises at least one arm (9) adapted to swivel over the edge of the cover (6) and rest on a pressing surface (10) of the cover (6) in the closed position of the cover (6) and the locking clamp (8).

9. The socket according to claim 8, wherein the pressing surfaces are formed in the center relative to the plug-receiving opening (4) between the arm (9) of the locking clamp (8) and the cover (6) in a direction transversely to swiveling axes of the cover (6) and the locking clamp (8).

* * * * *

UNITED STATES PATENT AND TRADEMARK OFFICE

CERTIFICATE OF CORRECTION

PATENT NO. : 8,888,515 B2
APPLICATION NO. : 13/814363
DATED : November 18, 2014
INVENTOR(S) : Gary Hachadorian It is certified that error appears in the above-identified patent and that said Letters Patent is hereby corrected as shown below:

On the Title Page, (73) Assignee: Delete "Frieberg", and insert -- Friedberg --.

Signed and Sealed this
Fourteenth Day of April, 2015

Michelle K. Lee

Michelle K. Lee
*Director of the United States Patent and Trademark Office*